United States Patent [19]

Arai et al.

[11] 4,069,656

[45] Jan. 24, 1978

[54] COMPOSITE SPUN YARN AND PROCESS FOR PRODUCING THE SAME

[75] Inventors: Yoshiyasu Arai, Toyonaka; Toshiaki Hokudo; Masanori Saka, both of Takatsuki, all of Japan

[73] Assignee: Toyo Boseki Kabushiki Kaisha, Osaka, Japan

[21] Appl. No.: 591,894

[22] Filed: June 30, 1975

[30] Foreign Application Priority Data

June 28, 1974 Japan ..... 49-74449

[51] Int. Cl.[2] ..... D02G 3/38

[52] U.S. Cl. ..... 57/160; 57/144; 57/157 F

[58] Field of Search ..... 57/157 F, 160, 144

[56] References Cited

U.S. PATENT DOCUMENTS

| | | | |
|---|---|---|---|
| 2,731,789 | 1/1956 | Holder | 57/160 |
| 3,403,501 | 10/1968 | Nuissl | 57/157 F X |
| 3,427,647 | 2/1969 | Field, Jr. | 57/160 X |
| 3,439,491 | 4/1969 | Scruggs | 57/160 |
| 3,685,268 | 8/1972 | Seguin | 57/160 X |
| 3,722,202 | 3/1973 | Indarte | 57/160 X |
| 3,756,005 | 9/1973 | Seguin | 57/157 F X |
| 3,763,640 | 10/1973 | Nagel et al. | 57/160 X |
| 3,945,189 | 3/1976 | Allen | 57/160 |

*Primary Examiner*—Richard C. Queisser
*Assistant Examiner*—Charles Gorenstein
*Attorney, Agent, or Firm*—Wenderoth, Lind & Ponack

[57] ABSTRACT

A novel process for producing yarns at high speed by drafting a sliver or roving of short fibers. The process dispenses with rings, travellers or spindles, and a single gas false twist member is effectively used. The process comprises leading a bundle of short fibers to said false twist member and feeding to the twisting zone of the bundle of short fibers an extremely fine multifilament yarn preferably in contact over a rotary body, at a sufficiently low tension and at a speed faster by 50–90% than the spinning speed of the bundle of short fibers so as to restrain the fiber bundle within one-directional spirals and two-directional composite spirals. The resulting composite spun yarn has a good touch because the fiber bundle has become non-twisted. By changing production conditions, the yarn can be formed into any desired shape from even yarn to nep yarn.

9 Claims, 6 Drawing Figures

COMPOSITE SPUN YARN AND PROCESS FOR PRODUCING THE SAME

BACKGROUND OF THE INVENTION

There are various processes or means for producing yarns by drafting a sliver or roving. The most general process for forming yarns comprises rotating a heavy package inserted into a spindle so as to give a true twist to a continuous bundle of short fibers. Such processes include for example ring spinning, mule spinning and flyer spinning. The spinning speed of these spinning processes is theoretically at most 30 m/min and a higher speed is not expected. On the other hand, the open-end spinning, which comprises temporarily breaking the continuity of the bundle of short fibers and feeding fibers one after another to the end of a yarn which has been already formed, while twisting the yarn, is being spotlighted. This process is now largely employed for production because of its higher productivity as compared with the former. By this process, however, the production of fine count yarns is difficult and the spinning speed remains at 2–3 times that of the former. Thus this process has not yet reached the stage of innovation. Recently, various proposals have been made on processes for producing yarns by utilizing false twist, without breaking the fiber bundle. It is well known that the productivity of these processes is markedly high in comparison with the ring spinning process. Representative of such processes is U.S. Pat. No. 3,079,746 (Fasciated Yarn Process and Apparatus for Producing the same) published on Mar. 5, 1963. As seen from its Examples, the spinning speed in the case of synthetic fibers is 914 m/min, showing a sufficient novelty indeed, but when cotton for example is used, the speed is as low as 36.6 m/min. Deviated from spinning processes of yarns, U.S. Pat. No. 3,427,647 (Wrapped Yarn Product and Process for Preparing Wrapped Yarns) published on Feb. 11, 1969 discloses a process for producing peculiar yarns. This process, intended to obtain an extremely thick covered yarn for use in non-textile fields, comprises wrapping a single filament yarn or a plurality of filament yarns around a plurality of yarns or filament yarns over nearly the whole periphery, with the twisting step being replaced with a false twist step. Anyway, there has not yet appeared any high speed spinning technique of a bundle of short fibers in the form of fleece. In the twisting or yarn forming step in both above-mentioned patents, a false twist apparatus utilizing air equipped with two air nozzles is used.

SUMMARY OF THE INVENTION

The present invention relates to a process for high speed spinning to obtain a novel composite spun yarn consisting mainly of short fibers and to the structure of said composite spun yarn. More specifically, the invention is concerned with a process for producing a composite spun yarn and the structure of said yarn, which process comprises leading a fleece-shaped bundle of short fibers drafted by a drafting apparatus to a single gas false twist member where the bundle of short fibers is temporarily false-twisted in one direction; and feeding to the twisting zone of the bundle of short fibers an extremely fine filament yarn below 50 denier preferably in contact over a rotary body, with the balloon of the bundle of short fibers being substantially removed, at a sufficiently low tension and at a speed faster by 50–90% than the spinning speed of the bundle of short fibers, thereby reciprocating the feed point of multifilament yarn along the bundle of short fibers for a length over 50 millimeters through a fixed yarn guide positioned at a considerable distance from said feed point by utilizing the twisting force by the false twist member and not by mechanical traverse, whereby the bundle of short fibers is rendered non-twisted after passage through the false twist member and the bundle of short fibers is restrained along its periphery by the multifilament yarn within one-directional spirals and two-directional complex spirals.

The primary object of the present invention is to rationalize the spinning process. Namely, the present invention provides a process which enables the production of a spun yarn at a speed 5–10 times higher than the ring spinning process. Also, the invention provides an energy economizing system such that only a single gas twist member is used in the formation of yarns. Further, in terms of yarn count, the invention enables the spinning of a single yarn up to 100 count (metric) at high speed which cannot be obtained by the open-end spinning process. Since the increasing of spinning-speed is very difficult especially for a ring spinning frame which is most widely used at present, the attainment of such speed-up has been a strong desire in the industry.

The second object of the present invention is an improvement in the practical properties of the cloth composed of the spun yarn. By wrapping the fine filament yarn around the bundle of short fibers, cotton cloths are prevented from wrinkling and the wool cloths from felting, without impairing the excellent properties such as good touch which the short fibers possess intrinsically.

Another object of the present invention is the integration of the production steps of multicolored fancy yarns. Fancy yarns have been usually produced by means of doubling and twisting already produced yarns together on the twisting machine. By the process of the present invention, it is possible to produce a fancy yarn directly from a sliver or roving in one step, which is a very great rationalization. Since this yarn has fine filament yarn wrapped around the periphery, a fancy effect can be easily developed by piece dyeing treatment. In addition, the appearance of the yarn is very even and the yarn has an advantage that any desired yarn count can be freely selected.

Other objects of the present invention will become apparent from the following description and annexed drawings.

DESCRIPTION OF THE PREFERRED EMBODIMENT

Figure 1:
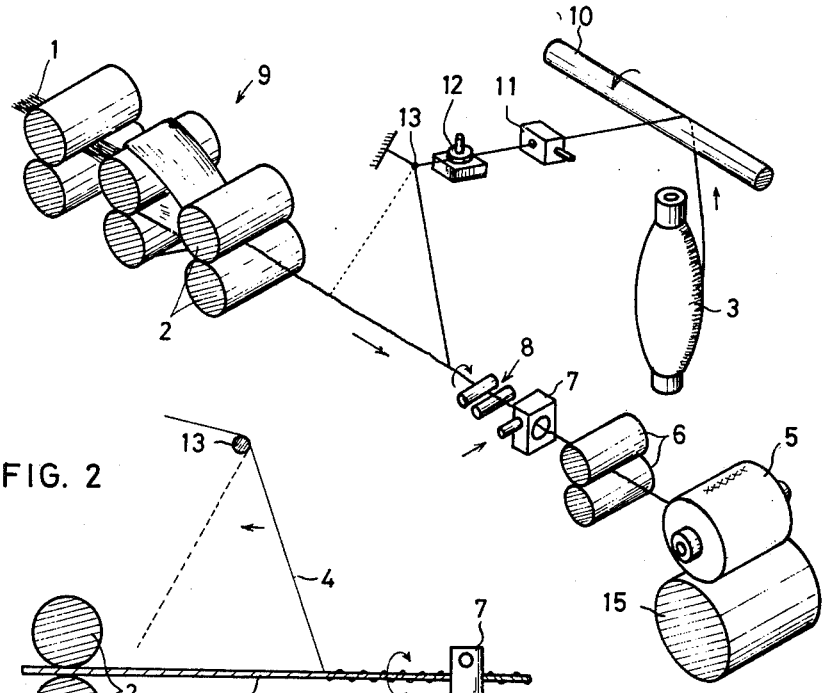
FIG. 1 is a sketch showing an example of practice of the present invention.

An example of the process of the present invention will be explained by reference to the sketch of FIG. 1. 1 is a roving of short fibers which is spun by being fed to the drafting apparatus shown as 9. 7 is a gas false twist member which is preferred to be of the conventional air vortex type. The gases to be used include air and other gases. 10 is a friction roller which is an example of rotary bodies. 15 is a winding apparatus. 2 shows delivery rollers of the drafting apparatus. 3 is a package of a multifilament yarn which is to be wrapped around the roving 1. 4 is a fine multifilament yarn. 5 is a take-up package. 6 shows take-up rollers. The gas false twist member 7 provides false twist for the fleece-shaped bundle of short fibers spun from the drafting apparatus 9, but the fiber bundle is untwisted after passing through the false twist member. Therefore, without use of a special intertwining yarn or a fiber fixing agent, the resulting fiber bundle cannot be formed into yarn. In a special case where the fibers contained in the bundle are sufficiently long, a yarn can be formed by binding the fibers with each other at the end portions of the fibers, as disclosed in the above-mentioned U.S. Pat. No. 3,079,746. However, speed-up of yarn production using cotton fibers is extremely difficult. Therefore, in the present invention, another yarn, i.e. an intertwining yarn is introduced which is spirally wrapped around the bundle of short fibers to restrain it. To form spirals around the fiber bundle, it is necessary to supply an intertwining yarn which traverses along the length of the fiber bundle. In the process of the present invention, an extremely fine continuous multifilament yarn 4 below 50 denier is used, which is fed at a rate in excess with respect to the spinning speed of the bundle of short fibers while passing in contact over the friction roller 10 to the bundle of short fibers 14 at the upper stream of the false twist member 7 through a tension controller 12 which enables the multifilament yarn 4 to maintain a suitable tension and through a fixed guide 13, with the balloon of the bundle of short fibers 14 being removed by a balloon removing device 8, so that the multifilament yarn 4 is spirally wrapped along and around the bundle of short fibers 14. Where a large spinning speed is provided, the tension controller 12 may be dispensed with. If necessary, an air feeder 11 may be positioned before or after the friction roller 10 so that the filament yarn 4 can be fed at a desired tension.

The process for producing a yarn covered with a filament yarn by means of balloon-phenomenon is known from U.S. Pat. No. 3,427,647. By this process, however, it is utterly impossible to obtain a spun yarn from fleece, because this patent is directed to another purpose. As a result of our intensive study, we have attained to this epoch-making invention which makes possible the high speed spinning of the bundle of short fibers in the form of fleece, as previously mentioned. The spun yarn in accordance with the present invention is provided with numerous non-twisted short fibers, most of which do not contribute to the yarn strength in radial directions, and the yarn also has one-directional spiral portions which cover more than half the length of the yarn.

Accordingly, the key point of the present invention is to let out a uniform, draft unevenness-free fleece from the delivery rollers of the drafting apparatus and to feed a fine multifilament yarn to excess by 50–90% in the mean value as compared with the feed by the delivery rollers. As mentioned in the Examples, when the excess feed surpasses 100%, the spirals become loose and this lowers the yarn strength to a great extent and impairs the appearance and touch of the yarn. Also, when the excess feed is less than 50%, the tension of the filament yarn becomes so high that the bundle of short fibers is pulled toward the supply side of the filament yarn and finally the twist does not reach the drafting rollers, so that yarn breaking is caused. Thus, to produce a good spun yarn, the feed amount of the filament yarn should be controlled by bringing it in contact with the friction roller.

Figure 2:
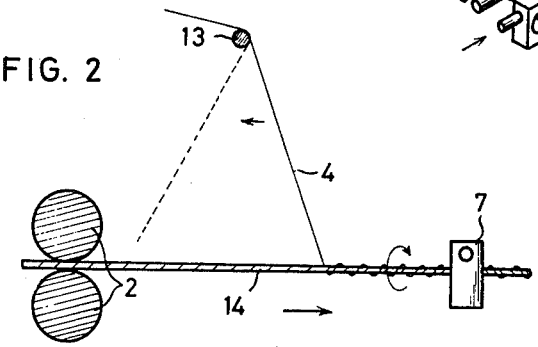
FIGS. 2 and 3 are pictures explaining the action, the former showing a side view and the latter a plan.
Figure 3:
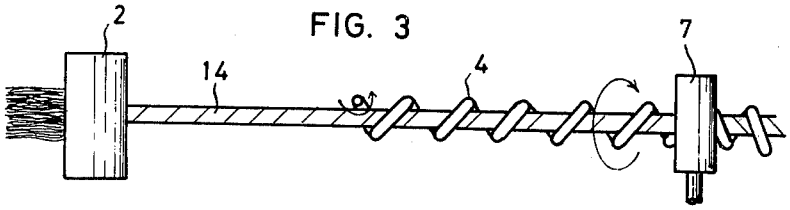

Next, the traverse phenomenon of the multifilament yarn is considered. Regarding the reason why the multifilament yarn automatically traverses along the bundle of short fibers in the production of the composite yarn of the present invention, this phenomenon may be considered to result from a repeated reversing movement caused by twist torque generated in the multifilament yarn, as explained in FIGS. 2 and 3. In FIG. 2, when the bundle of short fibers 14 is twisted by the false twist member 7 in the direction of the arrow, it is rotated to the S-twist direction. The multifilament yarn 4 introduced at this time is wrapped around the periphery of the bundle of short fibers 14 by its rotation, while the bundle of short fibers 14 is being moved at high speed in the direction of the arrow, i.e. toward the false twist member 7. Therefore, at the feed point, the multifilament yarn (intertwinning yarn) moves toward the upper stream while forming a spiral along the bundle of short fibers 14 by a continuously generated twist transmission force by the false twist member 7. In this way, when the intertwining yarn 4 and the bundle of short fibers 14 are reverse in the moving directions, the intertwining yarn 4, being given a rotary friction shown by the arrow as in FIG. 3, is twisted to have a Z-direction torque while it proceeds spirally. Further, the intertwining yarn 4 moves, while forming a spiral, in the same direction up to a torque which the intertwining yarn itself can endure, in other words, until the torque of the intertwining yarn reaches saturation. When the torque of the intertwining yarn reaches its saturation, the intertwining yarn upsets instantaneously on the bundle of short fibers as if a double twist would have been generated, and the movement of the intertwining yarn stops, i.e. the traverse stops. At the same time, the intertwining yarn moves over the bundle of short fibers by the Z-direction torque which the intertwining yarn possesses, to the reverse direction of the spiral traced over the portions of the bundle of short fibers that have been spirally wrapped with the intertwining yarn. Thus, the intertwining yarn releases the Z-direction torque. The movement is further continued until the Z-direction torque possessed by the intertwining yarn reaches zero and the yarn consequently becomes to have an S-direction torque. In this way, the intertwining yarn travels along the bundle of short fibers in the same direction as that of the latter, but they travel in the reverse directions again by the above-mentioned phenomenon, i.e. by the balance between the torque possessed by the intertwining yarn and the twist transmission force. Namely, the intertwining yarn travels in the reverse direction to the direction of the bundle of short fibers. Of course, the peripheral layer of the bundle of short fibers immediately after reversion, which has been already wrapped in different directions by two spirals of the intertwining yarn, is further wrapped spirally. However, as the traverse of the intertwining yarn proceeds, the yarn finally comes to the portion around which it will be spirally wrapped for the first time, and at the same time it becomes to possess a Z-direction torque rapidly. The automatic traverse movement of the intertwining yarn i.e. the multifilament yarn 4 is therefore a result of the successive repetition of these reversal movements.

Figure 4:
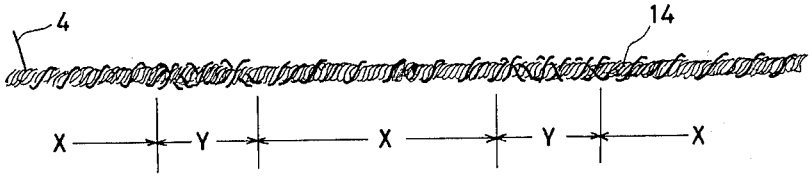
FIG. 4 is a picture showing the appearance in the twisting zone of the composite spun yarn composed of X and Y portions.
Figure 5:
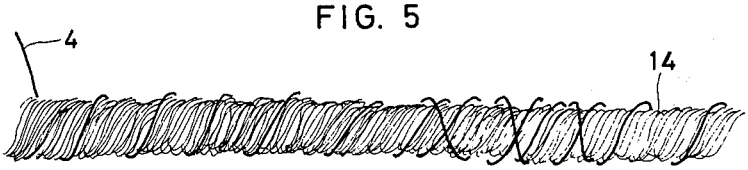
FIG. 5 is an enlarged picture explaining the yarn structure at the Y portion of FIG. 4.
Figure 6:
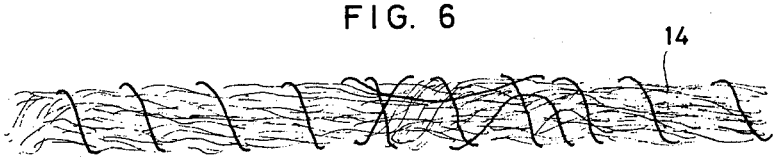
FIG. 6 is a sketch of the final composite spun yarn after untwisting, corresponding to FIG. 5.

When the conditions of this principle of traverse are modified by using the friction roller, various lengths of traverse can be given. Namely, when the torque given to the multifilament yarn is large, in other words, when the feed tension of the multifilament yarn is comparatively high, the length of traverse can be shortened. On the contrary, when the torque given is small, the length of traverse can be lengthened. When the air feeder 11 is used in combination, the feed tension of the multifilament yarn can be controlled to a further extent. Also, the length of traverse can be altered by changing the height of the fixed guide 13. With the same filament yarn, the larger the height the longer is the time to saturation of its torque, so that the length of traverse can be lengthened. When a false-twisted yarn is used instead of the multifilament yarn, a strange traverse appears due to the inherent torque of false twisted yarn which travels unstably with respect to the fixed guide 13. Explaining the state of the bundle of short fibers and the spiral multifilament yarn in the twisting zone by reference to FIG. 4, one-directional spiral portions X and two-directional complex spiral portions Y appear alternately. FIG. 5 is an enlarged picture of the latter complex spiral portion. FIG. 6 shows how this portion is untwisted after passing through the false twist member 7. The figure shows that the bundle of short fibers 14 is substantially untwisted and two oppositely directed spirals of the multifilament yarn 4 intertwine with each other so that the bundle of short fibers 14 can be held tightly. Results of experiments showed that the average length of the one-directional spiral above 80 mm was preferred in terms of quality of products. Under certain conditions, this length was able to be above 200 mm. As regards the average pitch of the one-directional spiral, a length above 2 mm was preferred because the soft touch of short fibers is then rich. A length above 3 mm, however, will cause a problem in post-processing because of a drop in yarn strength. When the length X of the one-directional spiral is equal to or above the length Y of the complex spiral, even if the pitch is 1–2 mm, the composite spun yarn has the preferred touch which short fibers intrinsically possess. All pictures show a multifilament yarn withdrawn from a single pirn or cone and fed from one direction. But the multifilament yarn is not limited to such conditions. Filament yarns may be fed from plural pirns to the same position or different positions, or another type of yarn may be used in combination. As for the fixed guide 13, mere metallic one is shown, but those consisting of synthetic materials may be used. When the contact friction is altered by changing hardness, the period of traverse may be made shorter or by lengthening the lengths of the one-directional spiral portions, the distance of traverse may be altered.

EXAMPLE 1

Using the same apparatus as shown in FIG. 1 except for omitting the air feeder 11, the spinning was carried out under the following conditions:

a. Short fibers: wool (average fiber length: 85 mm, single fiber denier: 4.5)
b. Filament yarn: Polyester yarns including six types of 75D/36f, 65D/24f, 50D/24f, 30D/12f, 20D/12f and 15D/1f.
c. False twist: Air vortex type, 2.5 kg/cm$^2$ G
d. Spinning speed: 120 m/min
e. Yarn count 1/30 (metric)

The following results were obtained.

| | Operability | Yarn Strength (g) | Coefficient of variation in strength | Elongation |
|---|---|---|---|---|
| 75D/24f | Poor | — | — | — |
| 65D/24f | Poor | — | — | — |
| 50D/24f | Good | 277 | 19.2 | 12.3 |
| 30D/12f | Excellent | 312 | 10.5 | 12.4 |
| 20D/12f | Excellent | 255 | 14.2 | 12.6 |
| 15D/1f | Poor | — | — | — |

The filament yarn should be a multifilament yarn. But even with multifilament yarns, those exceeding 50 denier markedly lower the spinnability. In contrast, no substantial yarn breaking was observed for 20 denier or 30 denier filaments. As regards the structure of the composite spun yarn spun under the above-mentioned conditions using a 30D/12f yarn, the average length of the one-directional spiral portions was 142 mm, and that of the two-directional complex spiral portions was 74 mm. The average pitch of the former was 1.52 mm.

EXAMPLE 2

With the same apparatus as in Example 1, the spinning was carried out under the following conditions:

Short fibers: cotton (average fiber length; 28.7 mm, single fiber denier: 1.7)
Multifilament yarn: polyester 20D/12f
Spinning speed : 135 m/min
Yarn Count 60 (metric)

The air pressure of the gas false twist apparatus was varied within the range of 1.5 to 3 kg/cm$^2$ G. Column A and column B in the following table show data using a friction roller and not using it, respectively. As apparent from the data, when the friction roller is used the spinnability is improved and the number of neps, on which the evenness of the yarn depends, is greatly decreased.

| Air pressure kg/cm$^2$ G | Operability | | Yarn strength | | Coefficient of variation in strength | | Number of neps | |
|---|---|---|---|---|---|---|---|---|
| | A | B | A | B | A | B | A | B |
| 1.5 | Poor | — | — | — | — | — | 52 | — |
| 2.0 | Good | Good | 192 | 189 | 10.8 | 11.6 | 70 | 227 |
| 2.5 | Excel. | Good | 201 | 202 | 11.5 | 11.7 | 84 | 884 |
| 3.0 | Excel. | Poor | 196 | 200 | 11.4 | 11.8 | 107 | 1527 |

Measurement of the number of neps: according to IPI no./1000 m

In this experiment, the effect of the presence of the balloon removing device 8 was tested. In the absence of this device, starting operation of the machine became easier but the quality was inferior; the yarn strength decreased by 15–25%, the coefficient of variation in strength increased by 10–20% and the number of neps increased. The number of yarn breaking also increased. As for the balloon removing device 8, contact of only a single cylindrical rod with the yarn was effective. Also, effective was bending of the yarn path of the bundle of short fibers in the twisting zone by means of one or two yarn guides. The friction roller 10 used in the Example was a brass roller having a diameter of 80 mm. Its surface speed was adjusted so as to correspond to an excess feed by 80–120% of the filament yarn. The friction roller which is an example of the rotary body may be a cylinder, fluted roller or gear-shaped roller. However, since the necessary feed length of the filament yarn varies within a definite period, at least for a cylindrical roller, a top roller (pressure roller) cannot be used so far as a reserve device is not used.

EXAMPLE 3

A composite yarn was spun by the method of Example 1 except that the air feeder 11 was added this time.

The materials used and the spinning conditions were as follows:

| | Short fibers | Multi-filament yarn | Air pressure (kg/cm²G) | Yarn count (metric) | Spinning speed (m/min) |
|---|---|---|---|---|---|
| (a) | Polyacrylic 3D × 80 mm | Polyester 30D/12f | 2.4 | 1/36 | 130 |
| (b) | Polyester/cotton (65/35) blended | Polyester 20D/12f<br>Polyamide 20D/6f | 2.4 | 1/30 | 150 |
| (c) | Polyester/ramie (50/50) blended | Polyester 20D/12f | 2.8 | 1/40 | 100 |

In this way, the spinning can be performed by using the air feeder 11 and friction roller 10 in combination. The feature of the (a) yarn is that a knit fabric prepared with this yarn does not give any limp hand even after piece dyeing. Conventional acrylic yarns have been kept from being piece-dyed because of this defect, but this yarn free from this limp hand can be safely handled. The (b) yarn is characterized by providing a fancy tone fabric utilizing its multicoloredness. Colorful fabrics can be easily obtained at an extremely low cost by piece dyeing. The (c) yarn is directed to hygroscopic summer wear materials. The difficulties in ramie spinning are substantially removed and the yarn breaking can be reduced to the order of wool spinning. In addition, the yarn count can be easily made higher.

Thus, we carried out various experiments using the above-mentioned production processes and mentioned the results in detail. We have already mentioned that the bundle of short fibers should be composed of spinnable fibers. Naturally, as shown in Examples, natural fibers such as wool, cotton and ramie and cut fibers of artificial fibers can be advantageously used. On the other hand, the multifilament yarn should have a fineness below 50 denier and in consideration of yarn formation it should have a low bending resistance. However, when ordinary artificial fibers for textile use are employed, there is no particular limitation on bending resistance. Multifilament yarns of polyester, polyamide or rayon are sufficient for this purpose.

What is claimed is:

1. A process for producing a composite spun yarn which comprises feeding a sliver or roving of short fibers to a drafting apparatus to prepare a continuous core bundle of short fibers, false-twisting said core bundle in one direction by passing the same through a subsequently situated single gas false twisting member, feeding a multifilament yarn below 50 denier through and in contact with a surface of a friction rotary body to the core bundle path upstream of the false twist member at a sufficiently low tension and at a speed faster by 50 to 90% than the spinning speed of the core bundle of short fibers, the core bundle being fed at a sufficient tension to prevent ballooning thereof, and reciprocating the feed point of the multifilament yarn back and forth for a length over 50 mm along the false-twisted bundle of short fibers, whereby the core bundle of short fibers is substantially untwisted after passage through the false twisting member and the core bundle of short fibers is restrained along its periphery by the multi-filament yarn.

2. The process as claimed in claim 1 wherein the bundle of short fibers is composed of cotton fibers.

3. The process as claimed in claim 1 wherein the bundle of short fibers is composed of wool fibers.

4. The process as claimed in claim 1 wherein the bundle of short fibers is composed of acrylic fibers.

5. The process as claimed in claim 1 wherein the bundle of short fibers is composed of a blend of polyester fibers and cotton fibers.

6. The process as claimed in claim 1 wherein the multifilament yarn is composed for polyester filaments.

7. The process as claimed in claim 1 wherein the multifilament yarn is composed of polyamide filaments.

8. The process as claimed in claim 1 wherein as the multifilament yarn two multicolor-dyeable polyester multifilament yarn are used.

9. The process as claimed in claim 1 wherein as the multifilament yarn two multifilament yarns, one a polyamide yarn an the other a polyester yarn, are used.

* * * * *